United States Patent [19]

Kumano

[11] Patent Number: 4,602,549

[45] **Date of Patent: * Jul. 29, 1986**

[54] KEYBOARD DEVICE HAVING CUSHIONED WEIGHT MEMBER FOR ELECTRONIC MUSICAL INSTRUMENT

[75] Inventor: Shinji Kumano, Shizuoka, Japan

[73] Assignee: Nippon Gakki Seizo Kabushiki Kaisha, Japan

[ * ] Notice: The portion of the term of this patent subsequent to Apr. 23, 2002 has been disclaimed.

[21] Appl. No.: 725,212

[22] Filed: Apr. 19, 1985

Related U.S. Application Data

[63] Continuation of Ser. No. 460,954, Jan. 25, 1983, Pat. No. 4,512,234.

[30] Foreign Application Priority Data

Jan. 26, 1982 [JP] Japan ..... 57-10450

[51] Int. Cl.[4] ..... G10C 3/12

[52] U.S. Cl. ..... 84/433; 84/439; 84/440

[58] Field of Search ..... 84/1.01, 1.15, DIG. 7, 84/425 R, 433, 439, 440, 467

[56] References Cited

U.S. PATENT DOCUMENTS 130,457 8/1872 Wenzel ..... 84/467

FOREIGN PATENT DOCUMENTS 49-10810 3/1974 Japan .

*Primary Examiner*—L. T. Hix
*Assistant Examiner*—Douglas S. Lee
*Attorney, Agent, or Firm*—Remy J. VanOphem

[57] ABSTRACT

Each key of a keyboard of an electronic musical instrument is mounted on a frame to be tiltable in the vertical direction and biased to a normal position by a return spring. Each key is incorporated with a weight member embedded in a cushion member. Preferably the cushioned weight member is mounted on the front end of each key and the cushion member is made of rubber. The cushioned weight member provides a refined responsive key touch sensation.

28 Claims, 18 Drawing Figures

KEYBOARD DEVICE HAVING CUSHIONED WEIGHT MEMBER FOR ELECTRONIC MUSICAL INSTRUMENT

This is a continuation of application Ser. No. 460,954 filed Jan. 25, 1983, now U.S. Pat. No. 4,512,234, issued Apr. 23, 1985.

BACKGROUND OF THE INVENTION

This invention relates to a keyboard device especially suitable for use in an electronic musical instrument.

Generally speaking, a keyboard mechanism for a musical instrument is required to be constructed such that when the key is initially depressed, the key gives a relatively heavy touch sensation to the performer, and the touch sensation decreases in the succeeding stage of key depression, and that a damper effect which manifests various musical shading can be provided so that the performer will not be tired even after a long performance. For example, in the performance of a music with a fast tempo, the mass of the key should be small, whereas for music of a slow tempo, the mass of the key should be large to increase a touch sensation. One example of the keyboard devices that satisfy these requirements is the keyboard device of a grand piano.

A keyboard device of a piano is constructed such that the conventional action mechanism is driven by a capstan button at the rear end of a key so as to strike a string. Accordingly, the construction is bulky. For this reason, a keyboard having this type of construction cannot be incorporated into an electronic musical instrument which is required to be compact.

A keyboard device having a construction as shown in Japanese Utility Model No. 10810/1974, has been used.

The key used in this keyboard device is molded with a synthetic resin and moved in a see-saw fashion about a fulcrum at the rear end of the key by a return spring.

More particularly, at the initial stage of the key depression, that is at an instant when a finger of the performer comes into contact with a key to rotate it against the force of a return spring, the heavy key is quickly moved from the stable state. Moreover, since the key has a substantially large inertia due to its weight it is to provide a large force to initiate the key depression and, consequently, a large reaction is applied to the finger when it is brought into contact with the key, thus causing fatigue in the fingers of the performer.

Once the key depression has started, the key, due to its inertia moves ahead of the movement of the finger with the result that the reaction disappears, thus decreasing the touch sensation. Although this tendency can be prevented by increasing the stiffness of the return spring, this measure increases the reaction against the performer's finger as the key is depressed, thereby decreasing which decreases the quality of the music performed.

When the key reaches a lower stop member, its speed is abruptly reduced to zero, again causing a large reaction.

SUMMARY OF THE INVENTION

Accordingly, it is a principal object of this invention to provide an improved keyboard for an electronic musical instrument, which imparts a responsive touch sensation at the time of performance, and can be operated for a long time without injuring the finger of the performer.

Another object of this invention is to provide a keyboard of an electronic musical instrument in which keys move as intended by the performer to manifest excellent musical effect and give a key touch sensation similar to that of a grand piano.

Briefly stated, a cushioned weight member is incorporated into a key.

In accordance with this invention, a keyboard of an electronic musical instrument is provided which includes a plurality of keys each mounted on a frame to be tiltable in the vertical direction and biased to a normal position, each key being incorporated with a weight member through a cushion member.

DETAILED DESCRIPTION OF THE PREFERRED EMBODIMENT

Figure 1:
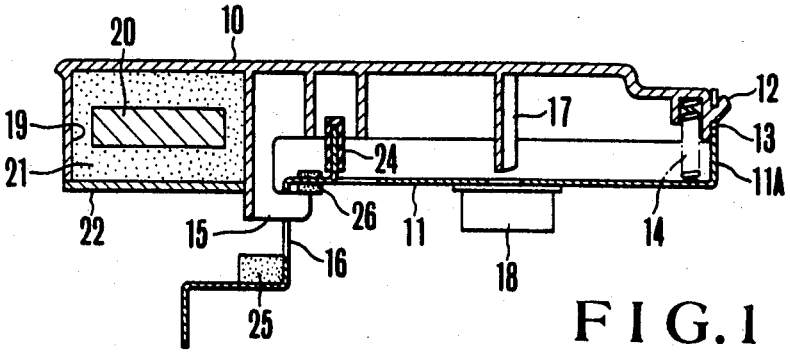
FIG. 1 is a longitudinal sectional view showing a keyboard of an electronic musical instrument embodying the invention.

In FIG. 1 a white or natural key is illustrated as a typical key. An elongated key 10 made of a molded synthetic resin has an inverted trough shaped configuration and is mounted on a frame 11 to be tiltable in the vertical direction.

More particularly, the key is formed with a projection 12 at its rear end and the projection 12 is inserted into a perforation 13 of a vertical support 11A integrally formed with the rear end of the frame 11 so as to be tiltable in the vertical direction about the upper edge of the perforation 13. The key 10 is biased to rotate in the clockwise direction by a return spring 14. On the lower surface of the front end of the key 10 is formed a hook shaped depending stop member 15 for limiting the vertical movement of the key 10. The lower end of the stop member 15 is slidably received in a slot 16 of the frame 11 so as to be normally maintained in the horizontal position by an upward movement stopper 26. When depressed, the key 10 is rotated in the counterclockwise direction about the upper edge of the perforation 13 against the force of the return spring 14 until the stop member 15 abuts against a downward movement stopper 25. As a consequence, an actuator 17 actuates a key switch 18 mounted under the frame 11. As is well known, when the key switch 18 is actuated, a musical tone corresponding thereto is electrically produced.

According to this invention, a weight 20 is contained in a hollow space 19 at the fore end of the key 10 with a cushion member 21 surrounding therearound. The lower opening of the hollow space 19 is closed by a lid 22. Thus, the upper and lower surfaces of the weight 20 are supported by the key 10 via the cushion member 21, or the weight is embedded in the cushion member.

The weight 20 is made of such heavy material, such as iron or lead, while the cushion member 21 is made of an elastic material, such as natural or synthetic rubber, foamed polyurethane, or foamed silicon rubber, so that the weight can move in the vertical direction by compressing the cushion member 21. The lateral movement of the key 10 is limited by a key guide 24 bent up from the frame 11 and covered by cushion material.

The operation and effect of the key 10 will be described as follows with reference to FIGS. 2A through 2E.

Figure 2A:
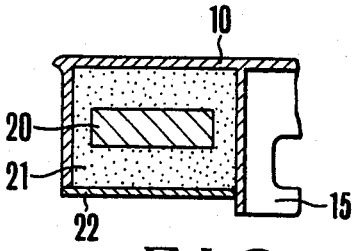
FIGS. 2A through 2E are partial sectional views showing the operation of a key incorporated with a weight and a damping or cushion member.
Figure 2D:
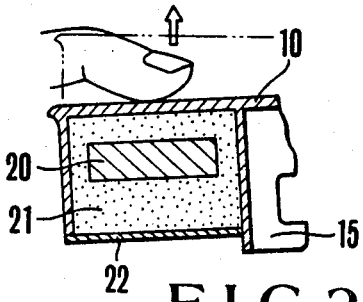
Figure 2B:
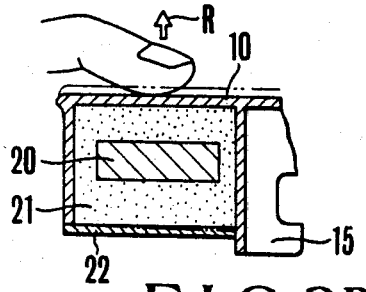

As shown in FIG. 2A, before depression, the weight 20 occupies substantially the central position of the cushion member. The cushion member 21 is compressed a little by the weight 20. In this state, as the key 10 is depressed, the main body thereof having a relatively small mass starts to move, whereas movement of the weight 20 is prevented by the damping action of the cushion member 21 as shown in FIG. 2B. Thus, the compressed cushion member stores energy. The reaction to finger pressure then increases gradually due to the release of energy stored in the cushion member.

Figure 2E:
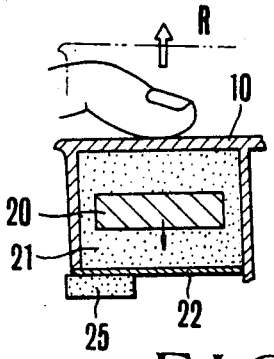
Figure 2C:
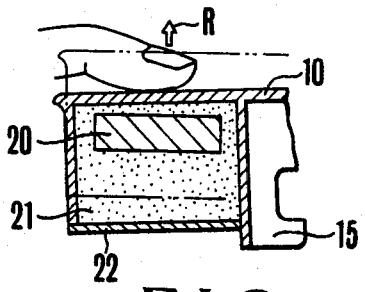

As the key is depressed further, the cushion member 21 will be compressed to a limit as shown in FIG. 2C at which time the weight 20 starts to move together with the key 10. The reaction force R acting upon the finger reaches a maximum while the key is moved downwardly but due to the presence of the cushion member 21, the reaction R and the acceleration of the key 10 does not become too large during the downward movement of the key.

When the performer changes the depressing force during the course of key depression force, that is when the force is increased, the cushion member 21 is further compressed to store more energy. As a consequence, the reaction R increases to manifest heavy key touch sensation. On the contrary, when the depression force is decreased, only the weight 20 tends to move by the energy stored in the cushion member 21. At this time, however, since the reaction of the cushion is applied to the key 10, the key 10 as a whole follows the movement of the finger without wandering apart from the finger.

As the key 10 is depressed further, unless the force of the finger is changed, the energy stored in the cushion member 21 will balance with the reaction R caused by the inertia of the weight 20 so that sufficiently responsive touch sensation can be insured. FIG. 2D shows this state.

When the key 10 is completely depressed to engage 25 as shown in FIG. 2E, the key 10 stops, but the weight 20 tends to continue its downward movement due to its inertia, so that the reaction R applied to the finger is small. When the downward movement stopper 25 is resilient, the reaction R can be decreased further.

When the key 10 stops in a manner as described above, the energy stored in the cushion member 21 is released tends to move the key 10 upwardly. The finger can sense this reaction just at a time when a musical tone produced by the key has built up. Thus the sensations of the finger and the ear of the performer coincides in time so that the performer can play satisfactorily.

Thereafter, although the weight 21 tends to vibrate in the vertical direction, such vibration is rapidly attenuated by the damping action of the cushion member 21 so that the next motion of the finger (key release) will not be effected.

Figure 3:
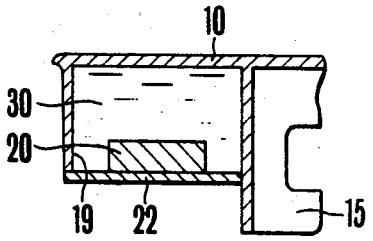
FIGS. 3 through 9 are partial sectional views showing other embodiments of this invention.

FIGS. 3 through 9 illustrate various modifications of this invention. In FIG. 3, a viscous liquid 30, for instance grease or oil, is used as the material for manifesting a damping effect. The viscous liquid 30 is contained in the hollow space 19 together with the weight 20.

Figure 4:
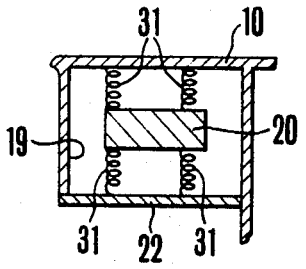
Figure 5:
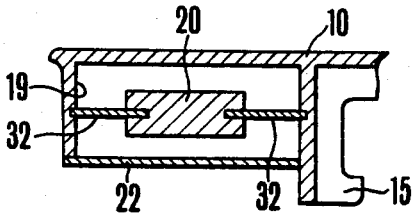
Figure 6:
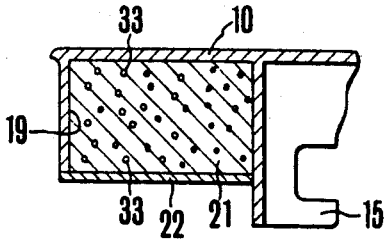

In FIG. 4, the weight 20 is supported by upper and lower pairs of springs 31, while in FIG. 5 the weight 20 is supported by a pair of leaf springs 32 interposed opposing walls depending from the upper surface of the key 10 and the weight 20. In FIG. 6, a metal powder 33 acting as the weight is dispersed in a damping member, such as rubber or foamed substance, while in FIG. 7 the metal powder 33 is suspended in the viscous liquid 30.

Figure 7:
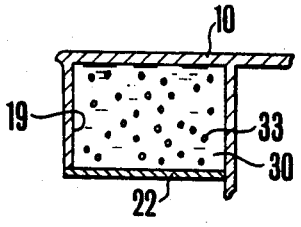

When the viscous liquid 30 is used as in FIGS. 3 and 7, it is necessary to suitably select its viscosity, specific gravity, and type of material such that the weight of the metal powder rests midway in the liquid 30 and does not float on the surface or sink to the bottom.

A combination of the viscous liquid and springs may be used to support the weight or rubber itself may be used as a weight and cushion material. In the modification shown in FIG. 6, the cushion member 21, made of rubber, for example, and containing metal powder 33 can be cast into the key 10. Furthermore, it is possible to insert the weight 20 into a rubber block and then incorporate the assembly into the key.

Figure 8:
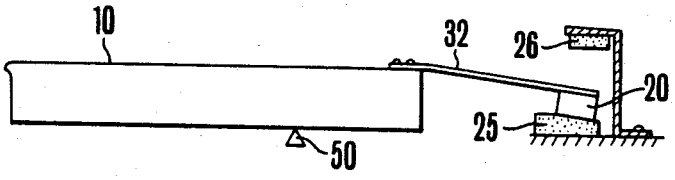

In another modification shown in FIG. 8, the leaf spring 32 is used as a cushion member and its base is secured to the rear end of the key 10 which is made of wood or plastic. The weight 20 is secured to the free end of the leaf spring 32 to engage with the downward movement stopper 25. In this case, a fulcrum 50 is provided at a point a little nearer to the front end of the key 10 from the weight center of the key assembly. In this modification too, the same effect as in FIG. 1 can be obtained at the initial stage of the key depression, since the weight 20 does not move due to the deflection of the leaf spring 32.

Figure 9:
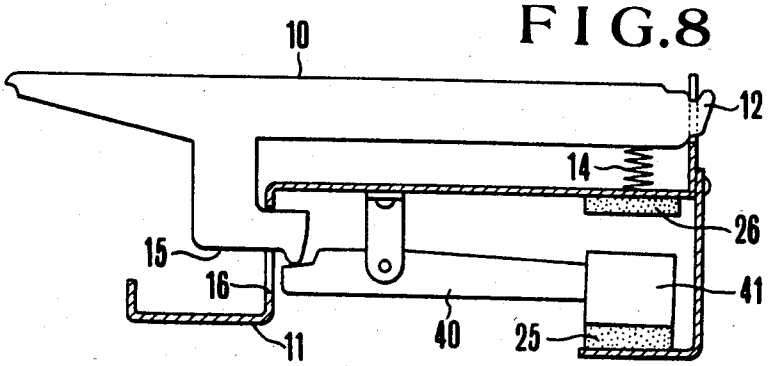

FIG. 9 shows still another embodiment of this invention in which the inner end of the hook shaped stop member 15 provided on the front end of the key 10 engages the front end of a pivoted lever 40 and a resilient weight 41 is secured to the other end of the lever 40 so as to drive the weight 41 in accordance with the depression of the key 10. The resilient weight 41 has the same construction as the key 10 shown in FIG. 7 so as to improve the touch sensation of the key.

It should be understood that the invention is not limited to the specific constructions described hereinabove. For example, the cushion member 21 dispersed with metal powder 33 shown in FIG. 7 may be provided along the entire length of the key 10, or the leaf spring 32 shown in FIG. 8 may be disposed beneath the key 10. In a key having a pivot point at the center, the weight 20 and cushion member 21 are secured to the rear end of the key.

Figure 10:
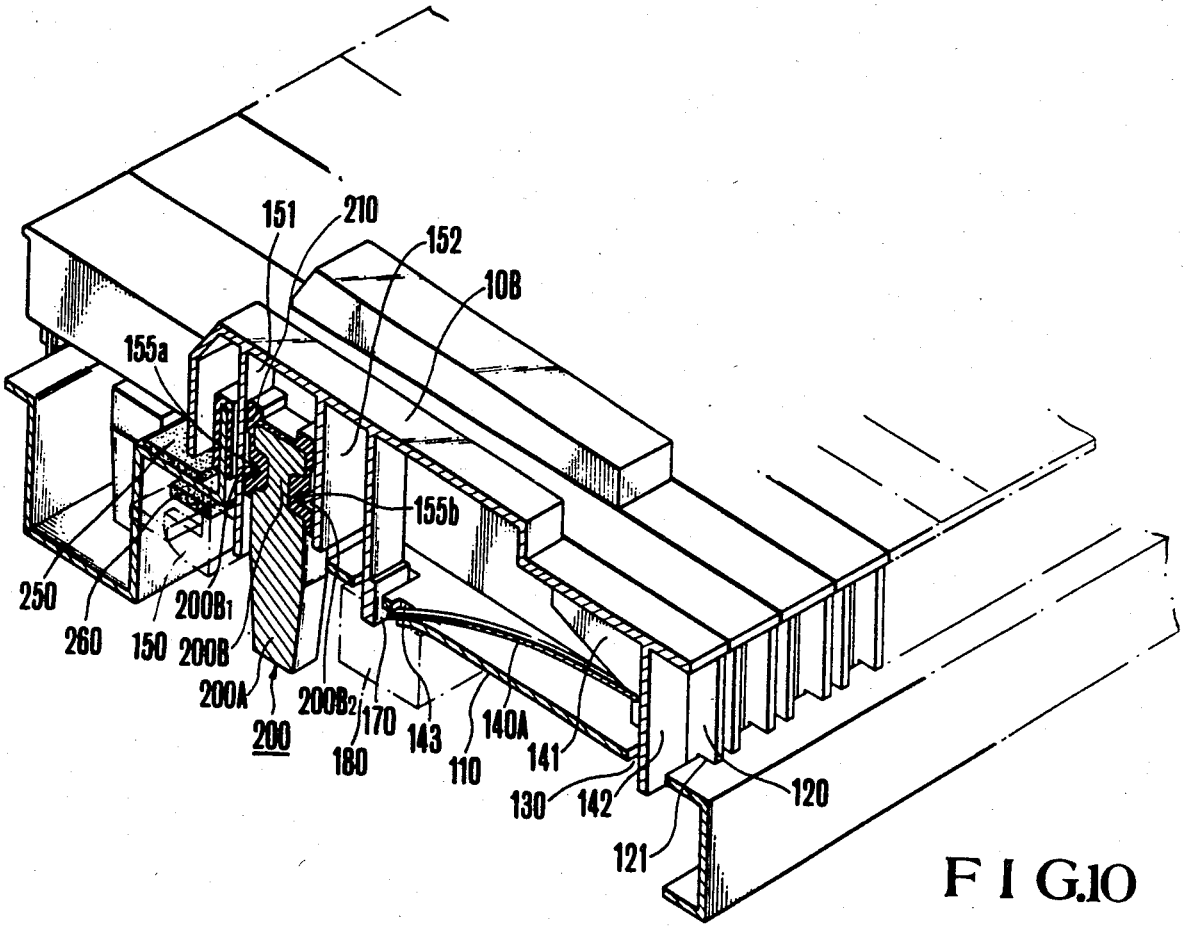
FIG. 10 is a perspective view, partly in section, showing another embodiment of this invention.

FIG. 10 shows still another modification of this invention. In this case, each key is molded from plastic and has an inverted trough shape having a plurality of partition walls. FIG. 10 shows longitudinal sections of natural and sharp keys, but both keys have the same fundamental construction although their lengths and positions of mounting the weights differ somewhat.

Accordingly, in the following, only sharp key 10B will be described. Thus, near the front end of the key an L-shaped stop member 150 is formed integrally with the partition wall 151 to project downwardly. The arm of the stop member 150 engages an upward movement stopper 260 made of felt on a frame 110 to limit the upward movement of the key, while a downward movement stopper 250 made of felt and arranged on an upper surface of the frame 110 receives the lower front end of the key 10B when depressed so as to limit its downward movement. A weight 200 combined with a cushion member 210 is contained in a cavity between the partition wall 151 and a next partition wall 152. More particularly, the weight 200 has a main body 200A having an inverted frustoconical configuration and projecting through an opening provided for the frame 110 and a rectangular support 200B extending upwardly from the main body 200A. The support 200B is dimensioned such that small gaps will be formed between it and the partition walls 151 and 152 and key side walls which define the cavity together with the partition walls 151 and 152. Recesses 200B1 and 200B2 are formed on a surface opposing the partition walls 151 and 152 whereby the support 200B is supported by a pair of pins 155*a* and 155*b* extending between two adjacent partition walls via the cushion member 210. The cushion member 210 is disposed at upper portions of the weight support 200B opposing the partition walls 151 and 152 and the side walls of the key and on the upper surface of the weight support 200B. As described above, the cushion member 210 is disposed at portions engaging the pins 155*a* and 155*b*. The reason for disposing the cushion member 210 only at limited portions of the weight support 200B lies in that, at portions other than those contacting the key walls the damping action is not efficient.

The cushion member 210 makes slidable contact with the partition walls and the key side walls. The upper surface of the weight support 200B is spaced from the rear surface of the key 10B slightly so as to permit slight vertical movement for the weight 200. The center of the key 10B is provided with an actuator 170 extending through the frame 100 for actuating a key switch 180. Furthermore, a projection 120 is provided at the rear end of the key 10B to be received in a perforation 130 of the frame 110. The projection 120 is provided with a notch 121 which engages with the peripheral edge of the perforation 130 to constitute a fulcrum point for the key. The key is normally biased to rotate in the clockwise direction by a return leaf spring 140A. The leaf spring 140A extends along an inclined surface of a depending wall 141 between a partition wall 142 and an opening 143 provided for the frame 110 near an opening for passing the actuator 170. Normally, the leaf spring 140A is curved, as shown, in a buckling state so as to impart a biasing force to the key 10B to cause it to rotate in the clockwise direction. As the key 10B is depressed, the leaf spring 140A is further deformed. The construction and operation of this return spring is described in detail in my copending U.S. patent application filed on Dec. 2 or 3, 1982 (serial number unknown).

The modification shown in FIG. 10 also manifests the desired damping action at the time of key depression, thus improving the key touch sensation and avoiding injury and fatigue to the finger.

FIGS. 11 through 14 are oscillograph displays showing the experimental results carried out by the invention. These results compare the characteristics of a prior art key and the key embodying the invention at the time of key depression. Throughout the FIGS. 11 to 14, the abscissa represents time while the ordinate of graph "a" shows displacement of a key upon depression. The ordinate of graph "b" is speed of key depression, the ordinate of graph "c" is acceleration of key depression, the ordinate of graph "d" is change rate of the acceleration, and the ordinate of graph "e" is bouncing displacement of a key upon returning to its normal position.

Figures 11, 12, 13, 14:
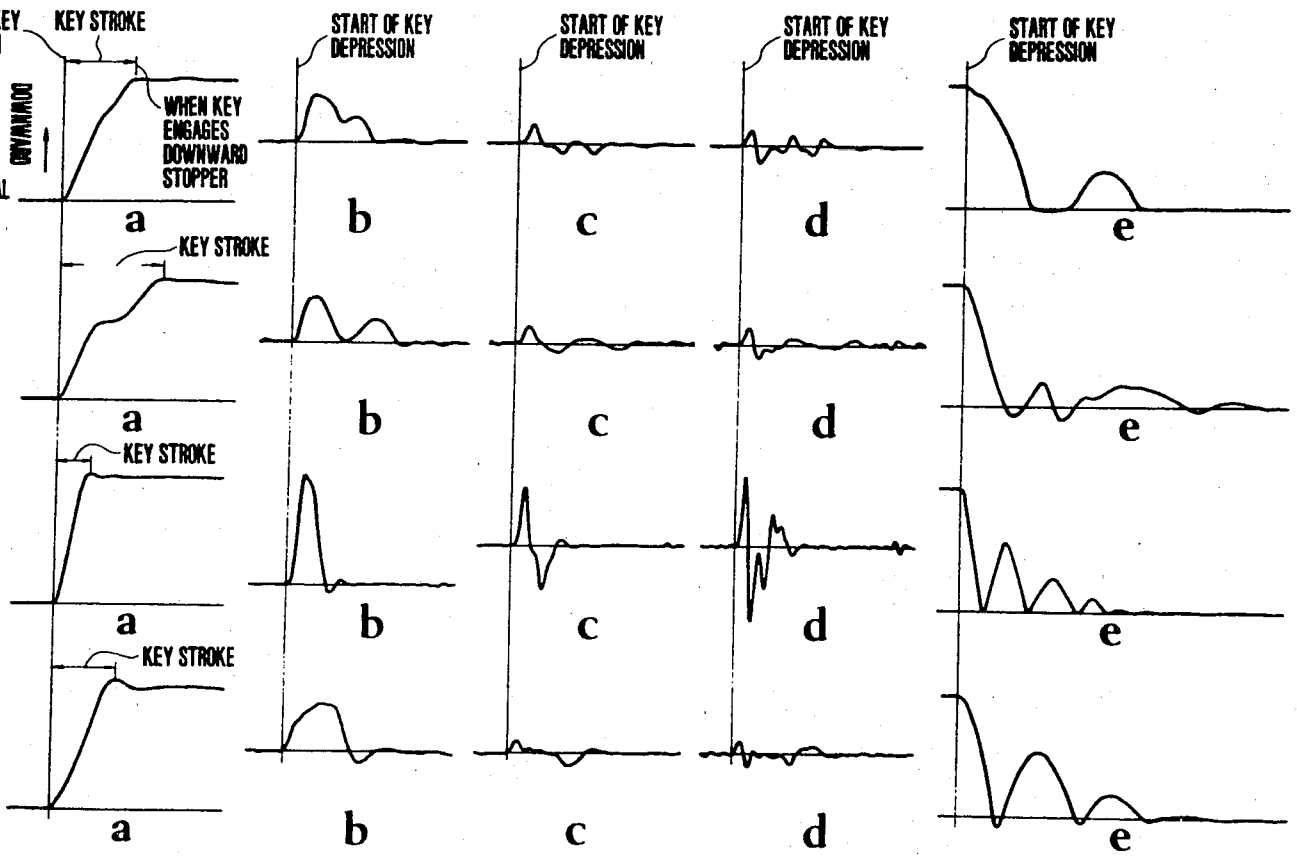
FIGS. 11*a* through 11*c* show operating characteristics when the key shown in FIG. 10 is used.
FIGS. 12*a* through 12*e* show operating characteristics of a key in a grand piano.
FIGS. 13*a* through 13*e* show control characteristics where plastic keys not incorporated with weights are used.
FIGS. 14*a* through 14*e* show control characteristics where weights are attached directly to plastic keys.

More particularly, FIG. 11 shows the characteristics of the keyboard shown in FIG. 10 in which a weight of 140*g* and a natural rubber cushion element are used. FIG. 12 shows the key depression characteristics of a grand piano, while FIG. 13 shows the characteristics of the keyboard shown in FIG. 10 when the weight is not used. FIG. 14 shows characteristics of a keyboard similar to that shown in FIG. 10, in which a weight of 70*g* is directly fixed to a key without using a cushion member.

Comparing the key depression characteristics of this invention shown in FIG. 11 and that of the keyboard shown in FIG. 13 in which the weight is not used and the key is made only of a plastic, FIGS. 11*a* and 13*a* show that the time between the initiation and end of the key depression is shorter in a key not including a weight than the key embodying the invention. Comparison of the speeds of keys by using FIGS. 11*b* and 13*b*, reveals that the speed variation of a key not provided with a weight is concentrated at the commencement of key depression. As the comparison of FIGS. 11*c*, 11*d*, 13*c* and 13*d* shows the rate of speed variation, that is acceleration, and its rate of change of acceleration are larger in FIGS. 12*c* and 13*d*. This means that a key not incorporated with a weight has a lighter key touch sensation, but as the acceleration at the time of key depression is larger, the reaction produced when the key engages the lower stop member is also considerably large. Thus, in the case shown in FIG. 13, it is impossible to enjoy a responsive key touch sensation.

In contrast, as can be noted from FIG. 11*a*, the key embodying the invention has a relatively slow speed variation throughout the entire stroke of the key and, as shown in FIG. 11*b*, the speed of the key is lower than that of a key not provided with a weight. Further, FIGS. 11*c* and 11*d* show that the acceleration and its rate of change are decreased to less than $\frac{1}{3}$ of that shown in FIG. 13.

Summarizing these characteristics, in the key embodying the invention, the reactions at the time of key depression and at the time when the key abuts against the lower stop member can be made smaller than the case shown in FIG. 13 where the key is not incorporated with a weight since the speed and acceleration of the keys employing the invention are decreased. When these characteristics are compared with the characteristic of a grand piano, shown in FIG. 12, it can be noted that the characteristics of the present invention are similar in many points to the characteristics of the grand piano. Accordingly, with the keyboard of this invention, it is possible to provide a key touch sensation closely resembling that of the grand piano without using the complicated and bulky action mechanism of the conventional grand piano. Where the functions of the weight and the cushion member are well balanced, key touch sensations better than those of a piano can readily be obtained. Further, according to the present invention, by the suitable selection of the materials and layout of the weight and the cushion member, a touch sensation substantially the same as that of a grand piano can be obtained.

Considering the key return operation, with a plastic key not incorporated with a weight as shown in FIG. 13*e*, when the finger is separated from the key, the key is returned by the return spring so that the return speed is relatively high. Accordingly, when the key abuts against the upper stop member, the speed and deceleration of the key become zero which creates a large reaction causing the key to bounce. However, in comparison with the key embodying the invention, FIG. 11*e*, since the weight 200 is cushioned by the cushion member 210, the reaction and the bounce of the key are decreased. Where the frequency of natural vibrations of the key and weight are varied, these vibrations interfere with each other to quickly attenuate the bounce, whereby continuous quick key depression becomes easy to carry out.

The characteristic shown in FIG. 11*e* resembles that of a grand piano shown in FIG. 12 proving that according to the invention key touch sensations resembling those of a grand piano can be obtained.

FIGS. 14*a* through 14*e* show characteristics corresponding to those shown in FIGS. 11*a* through 11*e* of a key provided with a weight directly fixed at the front end thereof. These characteristics show that the total time of key movement is longer than a key not provided with the weight (see FIG. 13) and since inertia is increased at the initial stage of key depression due to the weight a heavier key touch sensation can be obtained. However, the energy applied to the key during the total time of movement thereof concentrates at the initial stage of key depression and at an instant at which the key engages the lower stop member. This tendency is more remarkable in a key not provided with a weight. This not only impairs efficiency but also sharpens deceleration when the key engages the lower stop member as can be noted from FIGS. 14*c* and 14*d*. Accordingly, there is a tendency of injuring the finger. Furthermore as shown in FIG. 14*e*, the deceleration of the key is sharpened due to the direct weight when the key engages the upper stop member. This causes a large reaction and long bounce.

Comparison of the characteristics shown in FIGS. 11 through 14 shows that the keyboard embodying the invention increases the responsive touch sensation at the time of key depression, and energy is absorbed by the cushion member when the key comes to engage the upper and lower stop members so that the reaction is limited to a value not injuring the finger. Consequently, the bounce at these times can be attenuated in a short time. The key touch sensation afforded by the keyboard according to the present invention resembles that of a grand piano which is presently considered ideal. Moreover, the key touch sensation can be designed to a condition desired by a performer.

It should be understood that the invention is not limited to the specific embodiments described above and that various changes and modifications will be obvious to one skilled in the art.

For example, the pins 155*a* and 155*b* shown in FIG. 10 can be omitted where the sliding contact friction between the partition walls and or key side walls and the cushion element is sufficiently large. In such case, the friction between the partition walls and or the side walls and the cushion member also provides a damping function.

What is claimed is:

1. A keyboard device of an electronic musical instrument comprising:

a frame;

a plurality of keys mounted to said frame, each of said plurality of keys having an upper portion; biasing means for biasing each of said plurality of keys to a normal predetermined position; and means for pivoting each of said plurality of keys in a vertical direction;

a weight member suspended below said upper portion of each of said plurality of keys; and means for suppressing movement of said weight member, said means for suppressing movement being mounted underneath said upper portion of the each of said plurality of keys to suppress movement of said weight member as each of said plurality of keys move in said vertical direction.

2. The keyboard device as claimed in claim 1 wherein said means for suppressing movement of said weight member is selected from the group consisting of natural rubber, synthetic rubber, and foamed synthetic resin.

3. The keyboard device as claimed in claim 1 wherein said means for suppressing movement of said weight member comprises at least one biasing means.

4. The keyboard device as claimed in claim 1 wherein said means for suppressing movement of said weight member comprises a viscous fluid.

5. The keyboard device as claimed in claim 2 wherein said means for suppressing movement of said weight member further comprises at least one pin having one end disposed in one of said selected group of natural rubber, synthetic rubber, and foamed synthetic resin, said at least one pin further having an opposite end attached to each of said plurality of keys.

6. The keyboard device as claimed in claim 1 wherein said means for suppressing movement of said weight member is in frictional contact with each of said plurality of keys.

7. The keyboard device as claimed in claim 1 wherein each of said plurality of keys further comprises an enclosure member mounted to the underside of said upper portion, said enclosure member having at least two opposing side walls, said weight member being located between said two opposing side walls.

8. The keyboard device as claimed in claim 1 wherein each of said plurality of keys further comprises:

a front end portion, a rear end portion, and an intermediate portion, said intermediate portion interposed said front end portion and said rear end portion.

9. The keyboard device as claimed in claim 8 further comprising a fulcrum positioned on said frame proximate said intermediate portion of each of said plurality of keys, said fulcrum tiltably supporting each of said plurality of keys.

10. The keyboard device as claimed in claim 8 wherein said weight member is positioned proximate said front end portion of each of said plurality of keys.

11. The keyboard device as claimed in claim 8 wherein said weight member is positioned proximate said rear end portion of each of said plurality of keys.

12. The keyboard device as claimed in claim 8 further comprising a leaf spring having a first end portion affixed to one of said plurality of keys and a second end portion affixed to said frame, said leaf spring biasing said one of said plurality of keys toward said normal predetermined position.

13. The keyboard device as claimed in claim 1 wherein said means for suppressing movement of said weight member comprises a resilient means and said weight member further comprises a metal powder disposed in said resilient means.

14. The keyboard device as claimed in claim 1 wherein said weight member further comprises a metal powder, and wherein said means for suppressing movement of said weight member comprises a viscous fluid, said metal powder being randomly disposed in said viscous fluid.

15. A keyboard device for an electronic musical instrument comprising:

a frame;

a plurality of keys mounted to said frame, each of said plurality of keys having an upper portion and being tiltable in a vertical direction between a predetermined normal rest position and a predetermined lower stop position, said predetermined normal rest and lower stop positions defining a key stroke;

means for biasing said plurality of keys toward said predetermined normal rest position;

means for stopping said plurality of keys at said predetermined lower stop position;

a weight member suspended below said upper portion of each of said plurality of keys; and means for dampening said weight member, said means for dampening being mounted underneath said upper portion of each of said plurality of keys such that said weight member opposes movement of each of said plurality of keys in a direction towards and away from said predetermined normal rest position to dampen said key stroke.

16. The keyboard device as claimed in claim 15 wherein said means for dampening is selected from the group consisting of natural rubber, synthetic rubber, and foamed synthetic resin.

17. The keyboard device as claimed in claim 15 wherein said means for dampening comprises at least one biasing means.

18. The keyboard device as claimed in claim 16 wherein said means for dampening further comprises at least one pin having one end disposed in one of said selected group of natural rubber, synthetic rubber and foamed synthetic resin, said at least one pin further having an opposite end attached to each of said plurality of keys.

19. The keyboard device as claimed in claim 15 wherein said means for dampening said weight member is in frictional contact with each of said plurality of keys.

20. The keyboard device as claimed in claim 15 wherein each of said plurality of keys further comprises an enclosure member mounted to the underside of said upper portion, said enclosure member having at least two opposing side walls, said weight member being located between said two opposing side walls.

21. The keyboard device as claimed in claim 15 wherein each of said plurality of keys further comprises:

a front end portion, a rear end portion, and an intermediate portion therebetween.

22. The keyboard device as claimed in claim 21 further comprising a fulcrum positioned on said frame proximate said intermediate portion of each of said plurality of keys, said fulcrum tiltably supporting each of said plurality of keys.

23. The keyboard device as claimed in claim 21 wherein said weight member is positioned proximate said front end portion of each of said plurality of keys.

24. The keyboard device as claimed in claim 21 wherein said weight member is positioned proximate said rear end portion of each of said plurality of keys.

25. The keyboard device as claimed in claim 21 further comprising a leaf spring having a first end portion affixed to one of said plurality of keys and a second end portion affixed to said frame, said leaf spring biasing said one of said plurality of keys towards said predetermined normal rest position.

26. The keyboard device as claimed in claim 15 wherein said means for dampening comprises a resilient means and said weight member further comprises a metal powder randomly disposed in said resilient means.

27. The keyboard device as claimed in claim 15 wherein said weight member further comprises a metal powder, and wherein said means for dampening comprises a viscous fluid, said metal powder being randomly disposed in said viscous fluid.

28. The keyboard device as claimed in claim 15 wherein said means for dampening comprises a viscous fluid.

* * * * *

UNITED STATES PATENT AND TRADEMARK OFFICE

CERTIFICATE OF CORRECTION

PATENT NO. : 4,602,549

DATED : July 29, 1986

INVENTOR(S) : Shinji Kumano

It is certified that error appears in the above-identified patent and that said Letters Patent is hereby corrected as shown below:

Column 1, line 1, after "HAVING" insert ---- A ----.

Column 1, line 2, after "FOR" insert ---- AN ----.

Column 1, line 11, delete "especially" and insert ---- which is ----.

Column 1, line 44, after "is" insert ---- necessary ----.

Column 3, line 17, after "member", first occurrence, insert ---- 21 ----.

Column 3, line 60, after "released" insert ---- and ----.

Column 5, line 40, delete "100" and insert ---- 110 ----.

Column 6, line 30, delete "12c" and insert ---- 13c ----.

UNITED STATES PATENT AND TRADEMARK OFFICE

CERTIFICATE OF CORRECTION

PATENT NO. : 4,602,549

DATED : July 29, 1986

INVENTOR(S) : Shinji Kumano

It is certified that error appears in the above-identified patent and that said Letters Patent is hereby corrected as shown below:

Column 8, line 13, delete "the".

Signed and Sealed this

Third Day of February, 1987

*Attest:*

*Attesting Officer*

DONALD J. QUIGG

*Commissioner of Patents and Trademarks*